US005119607A

United States Patent [19]

Horning et al.

[11] Patent Number: 5,119,607

[45] Date of Patent: Jun. 9, 1992

[54] COVER ASSEMBLY FOR GUY WIRES

[75] Inventors: Frederick A. Horning; Jerome F. Moshofsky; David L. Prevost, all of Portland; David M. Gray, Milwaukie, all of Oreg.

[73] Assignee: Epic Corp. dba Radar Engineers, Portland, Oreg.

[21] Appl. No.: 707,122

[22] Filed: May 28, 1991

Related U.S. Application Data

[63] Continuation of Ser. No. 434,725, Nov. 13, 1989, abandoned.

[51] Int. Cl.[5] ..... E04H 12/20

[52] U.S. Cl. ..... 52/147; 24/115 R

[58] Field of Search ..... 52/146, 147; 24/115 R, 24/135 N; 174/79, 136

[56] References Cited

U.S. PATENT DOCUMENTS

| | | | |
|---|---|---|---|
| 1,938,957 | 12/1933 | Fox | 24/115 R X |
| 2,061,306 | 11/1936 | Hocher et al. . | |
| 2,604,178 | 7/1952 | Steinmayer | 52/147 |
| 3,007,557 | 11/1961 | Price | 52/147 |
| 3,010,546 | 11/1961 | Phillips | 52/147 |
| 3,065,452 | 11/1962 | Osborn | 24/115 R X |
| 3,173,519 | 3/1965 | Sullivan . | |
| 3,177,542 | 4/1965 | James . | |
| 3,295,875 | 1/1967 | Fisher | 52/147 X |
| 3,428,742 | 2/1969 | Smith . | |
| 3,486,534 | 12/1969 | Terkel et al. . | |
| 3,523,515 | 8/1970 | Brown . | |
| 3,868,193 | 2/1975 | Schott . | |
| 3,897,664 | 8/1975 | Bogese, II | 52/147 |
| 3,999,340 | 12/1976 | Bogese et al. | 52/147 |

FOREIGN PATENT DOCUMENTS

| | | |
|---|---|---|
| 901186 | 1/1954 | Fed. Rep. of Germany . |
| 425932 | 6/1967 | Switzerland . |

*Primary Examiner*—Renee S. Luebke
*Assistant Examiner*—Suzanne L. Dino
*Attorney, Agent, or Firm*—Kolisch, Hartwell, Dickinson, McCormack & Heuser

[57] ABSTRACT

An improved cover assembly for an object disposed therein, such as a guy wire, is disclosed and includes a tube having inner and outer surfaces. Also, the tube is constructed with a tube hole formed adjacent an end thereof. Disposed within the tube is means for clamping the guy wire. The clamping means includes an actuating means. Coupled to the clamping means and extending outwardly through the hole in the tube, is means for maintaining the clamping means in a preselected position until it is desired to rotate the bolt to tighten or loosen the clamp. Also disclosed is a cover assembly including a plurality of clamping means and maintaining means.

18 Claims, 1 Drawing Sheet 10
12
14
16
18
20
22
24
26
28
30
32
34
34a
36
36a
38
40
42
44
46
48
50
52
54
56
56a
58
60
60a
62
64
66
68
4
5
6

COVER ASSEMBLY FOR GUY WIRES

This is a continuation of application Ser. No. 07/434,725 filed Nov. 13, 1989, now abandoned.

BACKGROUND OF THE INVENTION

The present invention pertains to cover assemblies for fastening to objects disposed therein and more particularly to marker cover assemblies that are attachable to guy wires.

It is known to fasten bright colored guy markers over portions of guy wires near the ground to make them readily visible to pedestrians. Additionally, the guy markers are constructed with a smooth outer surface to minimize the risk of injury to pedestrians should they accidentally walk into a guy wire.

Commonly, the guy markers are formed by extruding a plastic tube. The tube may be formed with a longitudinal slit therein defining opposing longitudinal edges. These edges may abut one another or overlap.

To position the guy marker over the guy wire the guy marker may be pried open temporarily to permit entry of the guy wire in the tube, or an end of the wire may be fed through the guy marker as one would feed electrical wire through conduit.

There has long been a need to prevent sliding of the guy marker relative to the guy wire. A suggested approach has been to include a clamping device with the guy marker so that the marker can be fixedly positioned on the guy wire.

Many clamps have been proposed such as those disclosed in U.S. Pat. No. 3,897,664 to Bogese, II and U.S. Pat. No. 3,999,340 to Bogese et al. In each of these patents, there is disclosed a clamp that is attached to an inner surface of a guy marker having a guy wire disposed therein. To close the clamp on the guy wire, a bolt is passed through a bore in a first clamp member and threadably received in a bore formed in a second, opposing clamp member. By rotating the bolt, it is threaded through the threaded bore, which causes the second clamp member to move toward the first clamp member.

A problem with past proposals like those disclosed above is that the clamps tend to close inadvertently due to normal vibration or other movement during shipping of the guy markers or while they are transported to the job site. The clamps close primarily because sliding can occur relative to the bolt/second clamp member (which are coupled via a threaded bore in the second clamp member) and the first clamp member. Another, ancillary reason for the inadvertent closing of the clamp is that vibration/movement causes the bolt to rotate, which in turn threads the bolt into the threaded bore causing the opposing clamp member to move toward the other.

The problem with clamps inadvertently closing is that it results in making installation difficult and it prolongs the time required for installing guy markers. Specifically, workers are required to perform the extra steps of checking to see if the clamp is open or closed, and if closed, are required to reopen the clamp before installation is possible.

Another problem with past proposals is that none of the clamps provides for the combination of metal-to-metal contact between the bolt head and the clamp and accessibility of the bolt head from outside of the guy marker. Metal-to-metal contact is preferred over the situation where the plastic guy marker is "sandwiched" between the bolt head and the clamp, i.e. metal-to-plastic contact.

When a clamp is designed to have metal-to-plastic contact, tiny cracks form in the plastic guy marker, also known as "starring", under the bolt head. Eventually, the "starred" plastic breaks away, thus permitting movement of the guy marker relative to the clamp which is the situation trying to be avoided in the first place.

Another problem with metal-to-plastic contact is that the plastic under the bolt head gradually travels out from under the bolt head. This is known as "creeping" by those skilled in the art.

Metal-to-metal contact is preferred because the problems of "creeping" and "starring" do not exist in this situation. It should be noted that the term phrase "metal-to-metal contact" as used herein is intended to have a broad definition including any type of metal. Additionally, it may include any hardened material, whether naturally occurring or synthetically produced, that does not substantially degrade under a clamping pressure.

Plastic-to-metal contact is shown in the clamps disclosed in the Bogese, II patent. Also, the clamp is not designed with a bolt head that is accessible for tightening the clamp from the outside of the guy marker. Rather, the clamps have recesses formed therein for receiving bolts that are passed through holes formed in the guy marker and into the recesses.

The effect of this design is to require more time for installation because the bolt head, or screw head as the case may be, is not accessible from the outside of the guy marker. Thus, workers have to carefully fit a socket wrench or screwdriver into the hole in the guy marker to tighten the clamp on the guy wire.

It is therefore an object of the present invention to provide a cover assembly that is easily and quickly attachable to an object disposed therein.

Another object of the present invention is to provide a marker cover assembly that is easily and quickly attachable to a guy wire.

Yet another object of the present invention is to provide a clamp that is usable with marker cover assemblies for guy wires and provides easy installation of the cover assembly on the guy wire by being dependably open and ready to receive a guy wire.

A still further object of the present invention is provide a clamp usable in a marker cover assembly for guy wires that provides for the combination of metal-to-metal contact between the bolt head and the clamp, and accessibility of the bolt head from the outside of the guy marker.

SUMMARY OF THE INVENTION

The present invention achieves the above objects by providing an improved marker cover assembly that is readily attachable to a guy wire and includes a tube having inner and outer surfaces with a longitudinal slit formed therein, and also having a tube hole formed adjacent an end thereof. Also included, and disposed within the tube, is means for clamping the guy wire. The clamping means includes an actuating means.

Next, coupled to the clamping means and extending outwardly through the hole in the tube, is means for maintaining the clamping means in a preselected open, non-collapsible position to ensure that the assembly is readily attachable to the guy wire.

These and other objects and advantages of the present invention will be more clearly understood from a consideration of the accompanying drawings and description of the preferred embodiment.

DETAILED DESCRIPTION OF THE PREFERRED EMBODIMENT

Figures 1, 2, 3, 4, 5, 6:
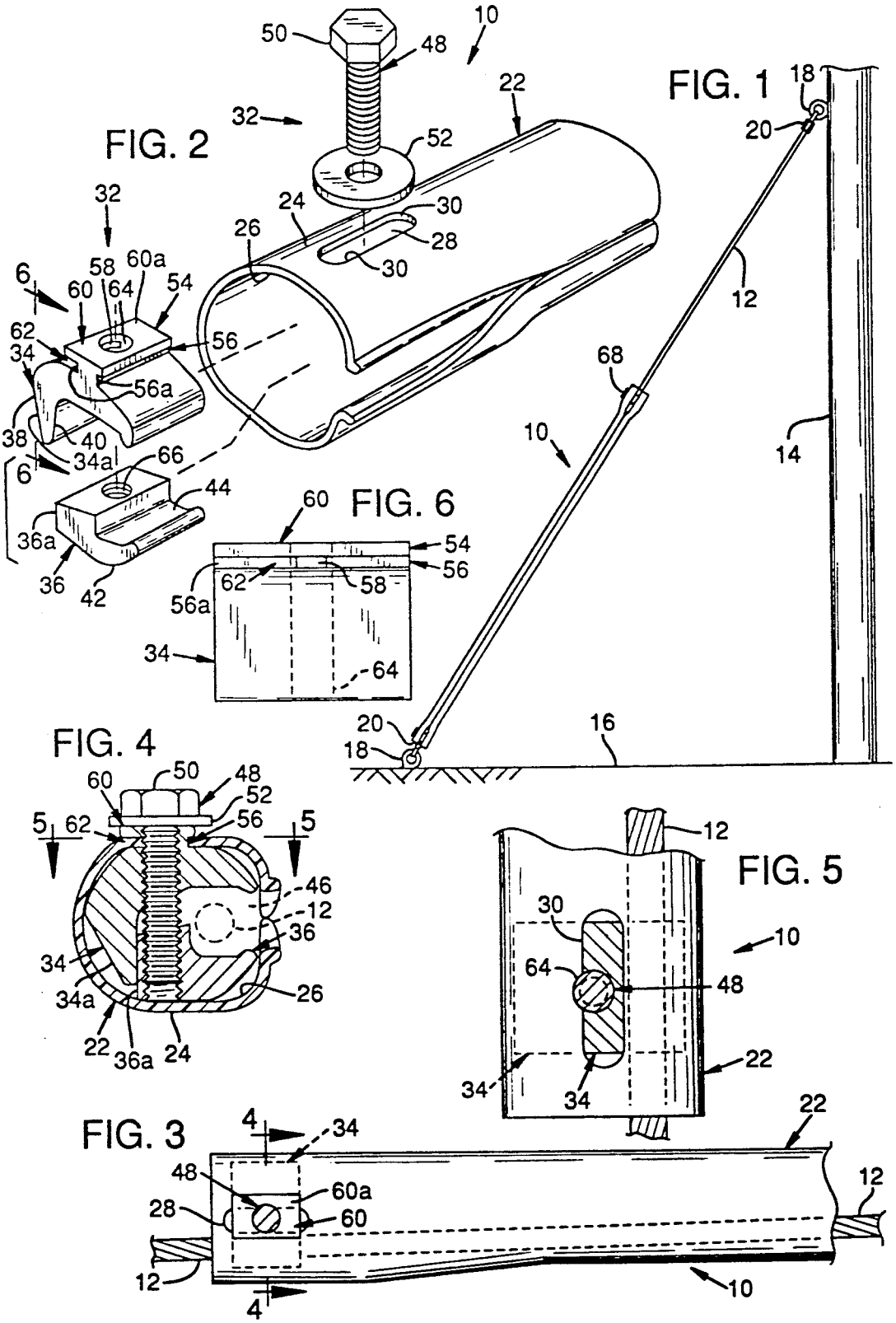
FIG. 1 is a perspective view of a typical pole being stabilized by a guy wire, with the apparatus of the present invention being used as a marker cover assembly for the guy wire.
FIG. 2 is an exploded, enlarged, fragmentary view of the apparatus of the present invention shown in FIG. 1.
FIG. 3 is a top, fragmentary view, on a smaller scale than FIG. 2 showing the apparatus of the present invention and the guy wire shown in FIG. 1.
FIG. 4 is a sectional view taken through the lines 4—4 of FIG. 3.
FIG. 5 is a top, fragmentary view through the lines 5—5 of FIG. 4 with portions of the apparatus of the present invention broken away to focus the viewer on certain features of the present invention.
FIG. 6 is an enlarged back view taken along lines 6—6 of FIG. 2, showing a portion of the clamping means that has slot formed therein.

Referring to Fig. 1, the marker cover assembly of the present invention is shown at 10, and is fastened around a guy wire 12 which is one of two guy wires (second guy wire not depicted) supporting pole !4. Pole !4 may be any type of pole that typically is supported using guy wires. Opposite ends of the guy wire are anchored to pole 14 and ground surface 16 by looping the guy wire through suitable anchor members 18 which have been driven into desired sections of the pole and ground surface. To complete the loop, the opposing ends of guy wire are positioned adjacent the remaining length of guy wire and are held in place with suitable clips 20.

With the above-described setting as background, the preferred embodiment of the apparatus of the present invention will be further described by referring to FIGS. 2-6. In FIG. 2, the lower end of assembly 10 as depicted in FIG. 1 is shown including a tube 22 having outer and inner surfaces 24, 26, respectively. The tube, or guy marker, is made by extruding a plastic tube made of high molecular weight thermoplastic. By using the term tube herein, it is intended that the term cover a broad range of possible shapes, as well as materials, that are suitable for protecting guy wires.

Additionally, tube 22 is a bright color, such as bright yellow, to make it easily visible to pedestrians. Finally, a longitudinal slit is formed in the tube, and defined by longitudinal edges of the tube. Preferably, to ensure that the tube retains its shape, the edges are turned inward when they are brought together so that a cross section of the tube (undepicted) looks approximately like the Greek letter omega.

Additionally, tube 22 is constructed with a tube hole 28 that is bounded by tube-hole-defining portions 30. The purpose for tube hole will soon be described.

Next, referring to FIGS. 2 and 4, means 32 for clamping guy wire 12 is disposed partially inside tube 22 and includes opposing first and second jaw members 34,36, respectively. Bolt 48 may also be thought of as an actuator or means for actuating clamping means 32. Clamping means 32 is preferably made with metal parts, each of which is soon to be described.

Members 34,36 each include outer and inner surfaces 38,40, and inner 42,44, respectively. Additionally, members 34,36 define a space 46 for receiving guy wire 12. Outer surfaces 38 and 42 are constructed to be generally arcuate to conform to inner surface 26 of the tube. Member 34 also includes an aligner section or planar expanse 34*a* extending toward member 36, and matable with a back surface or planar expanse 36*a* thereof, thus to maintain the jaw members in alignment defining space 46.

Still referring to FIGS. 2 and 4, clamping means 32 also includes a bolt 48 having a bolt head 50. Means 32 is also referred to herein as a fastener, and jaw members 34, 36 are also referred to herein individually as clamping members, and collectively as a clamp. A washer 52 may be used to equally distribute the clamping force produced by tightening the bolt in an operation yet to be described.

FIGS. 2 and 4 also show means 54 for maintaining bolt 48 in a preselected position until it is desired to tighten or loosen the clamping means. Such a preselected position of bolt 48 is shown in FIG. 4 and results in the clamp being held in an open position.

Referring to FIGS. 2 and 4, maintaining means 54 is shown including a ridge 56 coupled to member 34 of clamping means 32. Like clamping means 32, maintaining means 54 is also made preferably of metal. Ridge 56 extends outwardly of tube hole 28 and includes side surfaces 56*a* that abut tube-hole-defining portions 30.

Referring to FIGS. 2, 4, and 6, formed in one of side surfaces 56*a* is a slot 58 whose purpose will soon be described. A platform or bearing surface 60 is coupled to and disposed adjacent ridge 56. As will be described in detail, platform 60 is designed to be outside of the guy marker (FIG. 4) so that between it and outer surface 38 of member 34 there is defined a track 62 for holding an adjacent portion of the tube in a position abutting the ridge. The sections of member 34 that form track 62 may also be thought of as retainer means for engaging and holding the guy marker adjacent hole, or aperture, 28. Platform 60 also defines a metal contact for bolt head 50 when bolt 48 is rotated clockwise to tighten clamping means 32.

Referring again to FIGS. 2 and 4, aligned bores are formed in clamping means 32 and holding means 54 to permit bolt 48 to pass therethrough. Bore 64 is formed centrally in member 34, ridge 54, and platform 60 and is in communication with slot 58 for reasons soon to be described. Bore 66 is formed with threads to threadably receive bolt 48.

Finally, referring back to Fig. I, it may be desirable to include a plurality of clamping means and holding means in assembly 10. For example, in Fig. 1 a second clamping means and holding means are included in the top end of assembly 10 and are generally designated at assembly portion 68. The structure of assembly portion 68 is the same as that described in connection with FIGS. 2-6 above.

MODE OF OPERATION OF THE PRESENT INVENTION

Marker cover assembly 10 is readily attachable to guy wire 12 in the following manner. To make tube 22 ready for receiving clamping means 32, the same is pried open as shown in FIG. 1. Prying the tube open can be accomplished by hand or with a pliers (both undepicted).

Next, referring to FIGS. 2 and 4, member 34 is positioned in the enlarged end of a tube 22 by first pushing lip 60*a* of platform 60 through tube hole 28 and then positioning lip 60*a* so that it defines a track 62 for holding tube-hole-defining portions 30 of tube 22 in a position abutting ridge 56. Thus, the portions of member 34 that define track 62 form retainer means for engaging and holding the guy marker adjacent aperture 28.

Next, bolt 48 is placed through washer 52 and through aligned bores 64,66. Bearing surface 60, being disposed outside the guy marker, will receive and distribute the force applied to the clamp by the bolt when the same is rotated to force members 34, 36 together. An important feature of the invention is that bolt 48 will meet with some resistance when it is pushed through bore 64. Referring to FIGS. 3–6, the resistance is illustrated by showing that slot 58, in communication with bore 64, allows tube-hole-defining portion 30 to extend into bore 64. For example, in FIG. 5, the reader can see how tube-hole-defining portion 30 extends into bore 64.

Put another way, while directing the reader's attention to FIGS. 3–5, the reader will see that slot 58 allows a portion of a thread from bolt 48 to extend outward of ridge 56 through slot 58 and into engagement with a section of tube-hole-defining portion 30.

The engagement of the thread portion of bolt 48 with tube-hole-defining portion 30 is important because it results in the bolt, and most importantly members 34,36, being maintained in the "open" position shown in FIG. 4. In this "open" position, clamping means 32 cannot collapse because bolt 48 is maintained in the position shown. Thus, member 36 cannot slide inwardly toward member 34. This engagement allows assembly 10 to maintain an "open" position during normal vibration and other movements associated with shipping the assembly or transporting it to the job site.

Bolt 48 cannot rotate on its own because one of its threads is engaging tube-hole-defining portion 30. However, by rotating the bolt manually, as with a socket wrench or screw driver (the latter used if a screw is used instead of bolt 48), the resistance to sliding and rotational movement is overcome, thus allowing the clamp to be opened or closed.

Additionally, the reader can now understand that assembly 10 provides the combination of (1) bolt head 50 being easily accessible from outside tube 22 and (2) clamping means 32 having metal-to-metal contact between bolt 48, washer 52, and platform 60 when bolt 48 is tightened, to close clamp members 34,36 around guy wire 12.

While the present invention has been shown and described with reference to the foregoing preferred embodiment, it will be apparent to those skilled in the art that other changes in form and detail may be made herein without departing from the spirit and scope of the invention as defined by the appended claims.

It is claimed and desired to secure by letters patent:

1. An improved cover assembly that is readily attachable to an object disposed therein comprising:

a tube having inner and outer surfaces, and a tube hole formed adjacent an end thereof;

means for clamping the object, the clamping means disposed within the tube;

means for actuating the clamping means extending through the tube hole; and coupled to clamping means and extending outwardly through the tube hole, means for releasably maintaining the clamping means against a portion of the tube defining the tube hole, thus to hold the clamping means in a preselected open, non-collapsible position to ensure that the assembly is readily attachable to the object.

2. The assembly of claim 1 wherein the maintaining means releasably maintains the actuating means against the portion of the tube.

3. The assembly of claim 2 wherein the maintaining means includes a ridge extending out of the tube hole and abutting the portion of the tube, the ridge having a slot formed in a side surface thereof for allowing the actuating means to engage the tube portion.

4. The assembly of claim 3 wherein the maintaining means further includes a platform disposed normal to the ridge and coupled thereto outside the tube, the platform cooperating with the clamping means to define a track for holding the portion of the tube in a position abutting the ridge.

5. The assembly of claim 4 further including a plurality of corresponding tube holes, clamping means and maintaining means.

6. The assembly of claim 5 wherein the object is a guy wire.

7. The assembly of claim 4 wherein the platform and actuating means are formed of metal to provide metal-to-metal contact between the actuating means and the clamping means.

8. The assembly of claim 1 wherein the clamping means includes first and second jaw members positionable to define a space for receiving an object, the first member including an aligner section extending toward the second member and the second member including a back surface, the aligner section being matable with the back surface, thus to maintain the jaw members in alignment defining such space.

9. In a clamp disposed within a guy marker having inner and outer surfaces, a hole, and a longitudinal slit formed therein, and a guy wire disposed inside the clamp, comprising:

means for clamping the guy wire, the clamping means disposed within the guy marker;

means for actuating the clamping means; and coupled to the clamping means and extending outwardly of the guy marker through the hole formed therein, means for releasably maintaining the clamping means against a portion of a guy marker defining the guy marker hole, thus to hold the clamping means in a preselected open, non-collapsible position to ensure that the assembly is readily attachable to the guy wire.

10. The assembly of claim 9 wherein the maintaining means releasably maintains the actuating means against the portion of the guy marker.

11. The assembly of claim 10 wherein the maintaining means includes a ridge extending out of the guy marker hole and abutting the portion of the guy marker, the ridge having a slot formed in a side surface thereof for allowing the actuating means to engage the guy marker portion.

12. The assembly of claim 11 wherein the maintaining means further includes a platform disposed normal to the ridge and coupled thereto outside the guy marker, the platform cooperating with the clamping means to define a track for holding the portion of the guy marker in a position abutting the ridge.

13. In a clamp disposed within a guy marker having inner and outer surfaces and a longitudinal slit formed therein, and a guy wire disposed inside the clamp, the improvement comprising:

a first jaw member having a generally arcuate base defining a first jaw and including outer and inner surfaces, and a ridge extending outwardly from the outer surface of the base through a hole formed in the guy marker, the ridge including a side surface abutting a portion of the guy marker defining the hole, and the ridge having a slot formed in the side surface thereof;

the first jaw member also including a first bore extending therethrough and in communication with the slot in the ridge;

a second jaw member movable independently of the first jaw member, and having a second threaded bore formed therein;

a bolt disposed within the first bore and threadable into the second bore to tighten or loosen the clamp, the bolt having a portion of its thread extending through the slot in the ridge and engaging the portion of the guy marker, thus to maintain the bolt in a preselected position until it is desired to rotate the bolt to tighten or loosen the clamp.

14. The clamp of claim 13 wherein the first jaw member further includes a platform disposed adjacent the ridge outside of the guy marker to define a track for holding an adjacent portion of the guy marker in a position abutting the ridge.

15. The assembly of claim 12 wherein the platform and actuating means are formed of metal-to-metal contact between the actuating means and the clamping means.

16. A fastener for clamping a guy marker to a guy wire that has been fed therethrough, comprising:

a clamp disposed within the guy marker and extending outwardly through an aperture formed in the guy marker, the clamp including retainer means for engaging and holding the guy marker adjacent the aperture; and an actuator for forcing the clamp around a portion of the guy wire to fix the guy marker relative to the guy wire.

17. The fastener of claim 16 wherein the retainer means includes a bearing surface disposed outside the guy marker for receiving and distributing the force applied to the clamp by the actuator.

18. A fastener for clamping a guy marker to guy wire that has been fed therethrough, comprising:

a first clamping member disposed within the guy marker and partially extending outwardly through an aperture formed in it, the first clamping member having a planar expanse;

a second clamping member also disposed within the guy marker, and also having a planar expanse engageable with the first members expanse when the two members are aligned for clamping; and an actuator for clamping the two members around a portion of the guy wire with the engaging expanse orienting the clamping members in alignment.

* * * * *